US006869298B2

(12) United States Patent
Latsis

(10) Patent No.: US 6,869,298 B2
(45) Date of Patent: Mar. 22, 2005

(54) FLUORESCENT LAMP SOCKET SYSTEM

(75) Inventor: Chris Petros Latsis, Pleasanton, CA (US)

(73) Assignee: T-1 Lighting, a division of BJI Energy Solutions, LLC, New York, NY (US)

( * ) Notice: Subject to any disclaimer, the term of this patent is extended or adjusted under 35 U.S.C. 154(b) by 0 days.

(21) Appl. No.: 10/437,016

(22) Filed: Jul. 15, 2003

(65) Prior Publication Data

US 2005/0026483 A1 Feb. 3, 2005

(51) Int. Cl.[7] ..... H01R 13/62
(52) U.S. Cl. ..... 439/157; 439/232
(58) Field of Search ..... 439/157, 160, 439/159, 232, 233

(56) References Cited

U.S. PATENT DOCUMENTS 2,221,402 A * 11/1940 Kurtzon ..... 439/157
2,228,646 A * 1/1941 Summers ..... 439/157

* cited by examiner

*Primary Examiner*—Gary Paumen
(74) *Attorney, Agent, or Firm*—Torys LLP

(57) ABSTRACT

A socket unit for fluorescent lamps and especially cold cathode fluorescent lamps has a movable top cover which includes an integral support limb. When in the open position, a lamp is supported by the limb. When in the closed position, the lamp is cammed into engagement with a conductive socket that supplies power to the lamp. As the cover is rotated toward the open configuration, the support limb engages the lamp and pushes it out of engagement with the socket and lifts the lamp to a location where it can easily be removed. In alternative embodiments, the socket can accept a cold cathode fluorescent lamp by engaging a conductive lamp end cap or the socket can accept a conventional, two-pin fluorescent lamp with a pair of conductive clips, one for each pin. Orienting means may be provided to position the lamp for insertion into the socket clips.

10 Claims, 4 Drawing Sheets

FLUORESCENT LAMP SOCKET SYSTEM

BACKGROUND OF THE INVENTION

1. Field of the Invention

The present invention relates to electrical lighting fixtures and, more particularly, an improved socket system for use with fluorescent lamps, and especially Cold Cathode Fluorescent Lamps ("CCFL").

2. Description of the Related Art

Cold cathode fluorescent lamps are a miniaturized fluorescent lamp with unique characteristics, in addition to their size. Conventional fluorescent lamps require heated electrodes at both ends of the lamp for operation, necessitating a pair of terminals at each end so that a current can heat the filaments constituting the lamp electrodes.

Once the filaments are heated, a substantial voltage gradient is created between the electrodes to ionize the gas contained within the lamp. The ionization causes a glow which causes phosphors coating the interior of the lamp to glow brightly. Depending upon the choice of phosphors, the lamp can fluoresce in many shades and colors.

The cold cathode fluorescent lamp ("CCFL") normally has a diameter that is a fraction of that of the "regular", heated electrode fluorescent lamp. Because the electrodes can arc without being heated, the lamp operation is substantially cooler. Moreover, only a single electrical conductor is needed at each end to complete the lamp circuit.

Currently, sockets for cold cathode fluorescent lamps are u-shaped spring clip conductors that connect electrically with a conductive surface at each end of the lamp that is electrically coupled to an electrode. The lamp is press fitted into place and the spring clip socket holds the lamp and supplies energy to the electrodes.

Because of the fragility of the conventional cold cathode fluorescent lamp, both the insertion and removal processes of a lamp in and from such a socket is a delicate procedure. Without substantial precautions, lamps could be destroyed while attempting their insertion or removal. Such a mishap could prove to be costly, if personal injury followed.

There are no known health hazards from exposure to lamps that are intact and not broken. The major hazard from broken lamps is the possibility of sustaining glass cuts. Also, if the lamp envelope is broken the lamp integrity is compromised. Once the lamp is broken, then numerous chemicals and materials could be inhaled, ingested or contacted with the skin or eyes.

At least one supplier of such lamps, ALKCO, of Franklin Park, Ill., a division of JJI Lighting Group, Inc., recommends that a piece of paper be inserted under a lamp to be removed. Lifting up on the ends of the piece of paper provides a support sling which spreads the removal force over a larger area. The lamp can then be removed with less danger of breakage.

Conventional fluorescent lamps are of much larger diameter and may be considered sturdier and more robust, with fewer handling hazards. The sockets for such lamps in current use include a pair of conductive spring clips to engage the pins of the lamp. The lamps are oriented so that they slide into the socket and are then rotated through approximately 90° to engage the conductive clips.

This operation is not without hazards. Too forceful a rotation of the lamp could result in either the breaking of the pins which are connected to the lamp electrodes or potentially a rotation of the glass tube in the end fitting which could break the vacuum seal and disable the lamp. It is also possible to break the glass tube with all of the attendant consequences.

SUMMARY OF THE INVENTION

What is needed, and what is supplied by the current invention, is a bulb socket that can automatically seat and unseat a typical fluorescent tube or bulb without the need to manually manipulate the bulb to get it in and out of the sockets.

According to the present invention, there is provided a rotating lamp bracket or lamp holder into which a lamp can be placed. Preferably, the CCFL has a conductive end cap which can seat into a u-shaped spring clip socket and conductive arms. Alternatively, the socket can be adapted to contact whatever contact elements have been provided to power the electrodes. For the conventional fluorescent lamp, a pair of spring clip elements can be provided to engage the electrode pins at each end of the lamp.

When in the open position, the lamp can be supported by the brackets at each end. The brackets are adapted to rotate about an axis that is orthogonal to the axis of the lamps. Rotating the bracket then deposits the lamp ends into the waiting socket and further rotation of the bracket causes an interaction in which each bracket causes the lamp or bulb to be fully seated in the associated socket. The lamp is then fully locked into place by the rotating bracket by a positive friction fit slot-and-tab system built into bracket.

Removal of the bulb is then accomplished by rotating the brackets in the opposite direction. Support arms engage the ends of the bulb and continued rotation of the brackets urge the bulb out of the sockets until the bulb is supported wholly by the brackets. The operation is substantially similar for CCFL and conventional fluorescent lamps with the only difference being that the conventional lamp may require a built in orienting device to assure that the pins enter the spring clips.

Accordingly, it is an object of the invention to provide a socket system for fluorescent bulbs that facilitate insertion, locking and removal of the bulbs into frictional sockets.

It is an additional object of invention to provide a socket system for the easy and safe insertion and removal of cold cathode fluorescent lamps.

It is yet another object of the invention to provide a socket system that easily inserts and removes bulbs with conductive end caps into and from frictional spring clips that power the lamps by providing all necessary electrical contact to energize and operate the fluorescent lamp.

It is a further object of invention to provide a socket system for conventional fluorescent lamps that does not require rotation of the lamp to seat the conductive pins into conductive socket clips.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 4, including

FIG. 5, including

FIG. 6, including

DESCRIPTION OF THE PREFERRED EMBODIMENTS

Figure 1:
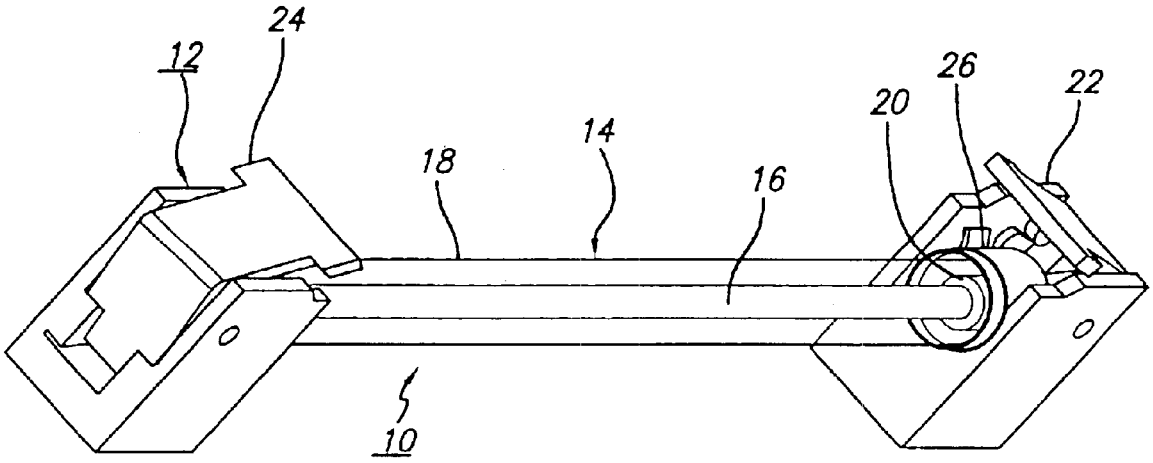
FIG. 1 is a perspective view of a lamp and socket combination.

Turning first to FIG. 1, there is shown a CCFL and socket assembly 10 employing the socket 12 of the present invention. As seen, there is a CCFL device 14 held by a pair of sockets 12 but not fully seated. The CCFL device 14 is an assembly taught by Marsh in U.S. patent application Ser. Nos. 09/598,009 and 08/630,361 all assigned to the assignee of the present invention.

The CCFL device 14 includes a CCFL bulb 16 that is supported within a cylindrical case 18 by resilient support means 20. A conductive end cap 22 secures the CCFL device and enables the CCFL electrodes to be coupled to a source of electrical energy.

Figure 2:
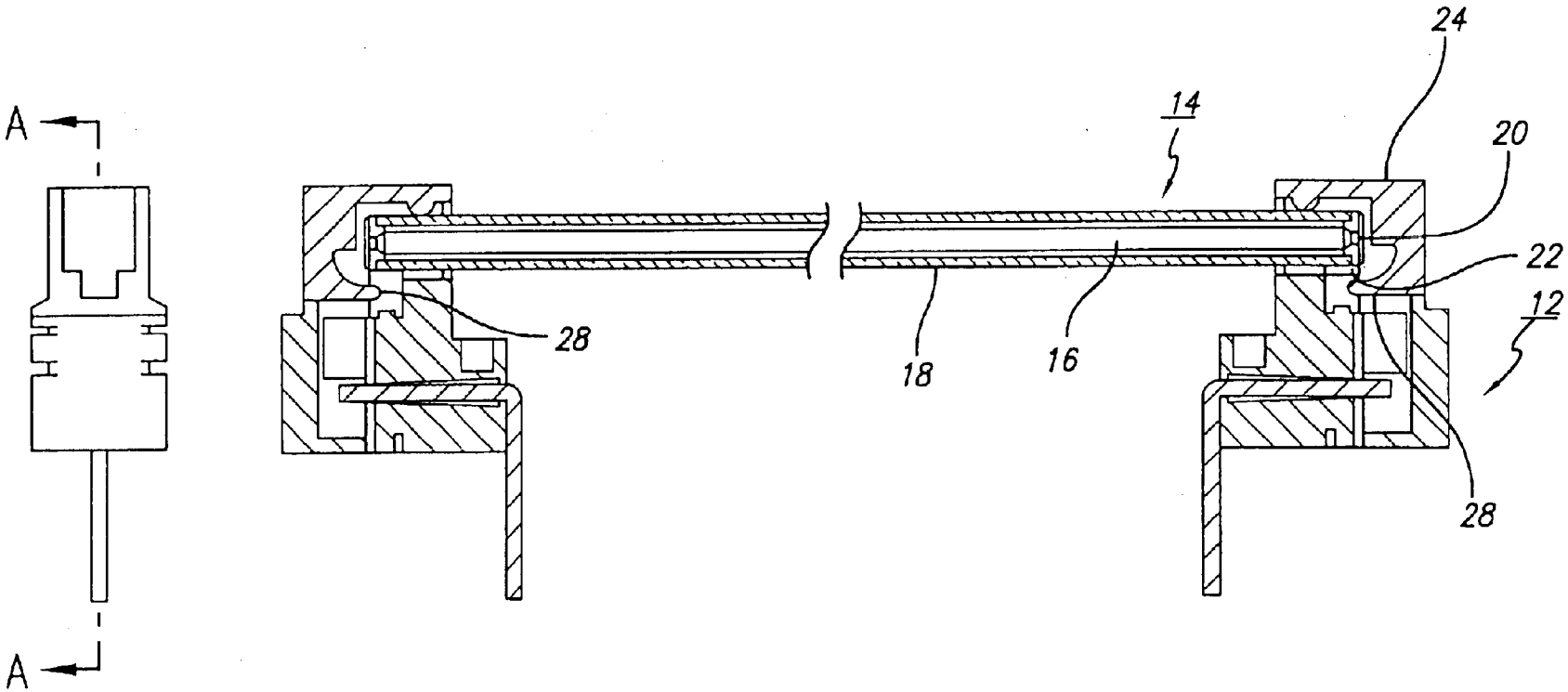
FIG. 2 is a side sectional view of a lamp and socket combination according to a preferred CCFL embodiment.

The socket 12 includes a rotating cover 24 which, in the open position, supports the bulb 16 above the socket 12 and, in the closed position, cams the conductive end caps 22 into full contact with a spring clip 26 that is connected to a source of electrical energy. To remove a bulb 16, the cover 24 must be rotated to the open position. A supporting arm 28, best seen in FIG. 2, below, pushes the bulb 16 from below, disengaging it from the spring clip 26. Further rotation then lifts the bulb 16 out of the socket 12. The fully inserted bulb 16 can be seen in FIG. 2.

Figure 3:
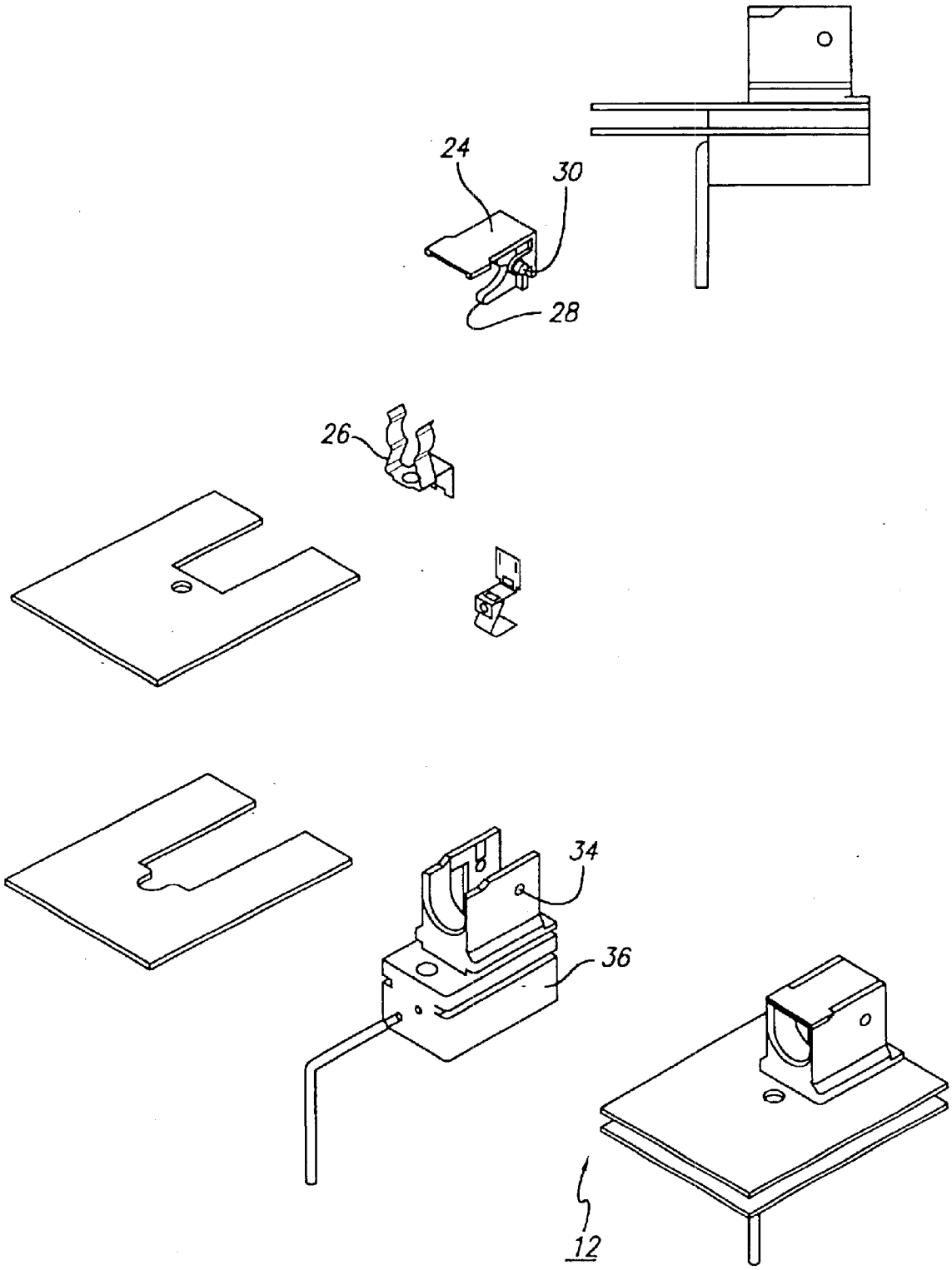
FIG. 3 is a an exploded perspective view of a socket according to the present invention designed for a CCFL.

The component parts of the socket 12 are shown in FIG. 3. The rotating cover 24 has an integral pin 30 on each side of the cover 24 which defines its axis of rotation. The pins 30 are mounted in apertures 32 in the side walls 34 of the socket base 36. The spring clip 26 is fastened to the socket base 36 between the side walls 34. As shown, the socket cover 24 is adapted to apply a downward force to the CCFL 14.

Protrusions (not shown) can be placed on the cover 24 which can cooperate with indentations in the side walls 34 of the base 36. These protrusions then can act s a "soft latch" to indicate when the cover 24 is closed or provide a slight resistance to opening the cover 24.

If the CCFL is constructed according to the teachings of Marsh, and as shown in FIG. 1, the socket cover 24 engages the cylindrical case 18 and end cap 22. If the CCFL does not have a protective cylindrical case 18, then the socket cover would engage the CCFL, directly if provided with a conductive end cap.

The supporting arm 28 is positioned to hold the CCFL 14 with the socket cover 24 in the open position. However, as the socket cover 24 rotates to the closed position, the supporting arm 28 rotates away as the CCFL 14 engages the spring clip 26. Opening the socket cover 24, the supporting arm 28 rotates into engagement with the CCFL 14 and applies a force to disengage it from the spring clip 26. As the rotation is completed, the CCFL 14 rests on the supporting arm 28 for easy removal and replacement.

Figure 4A:
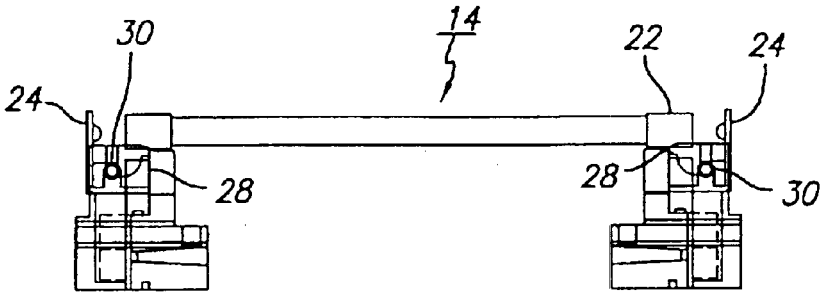
FIGS. 4A–4B, shows the initial stage of lamp insertion or the final stage of lamp removal.
Figure 4B:
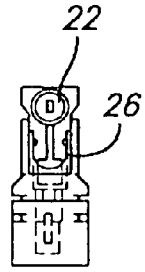

The operational sequence is shown in FIGS. 4–6. In FIG. 4A and FIG. 4B which are side and end views, respectively, the CCFL 14 is shown resting on the supporting arms 28 with the socket cover 24 in the fully open configuration. These FIGURES illustrate either the initial stage of insertion or the final stage of removal.

Figure 5A:
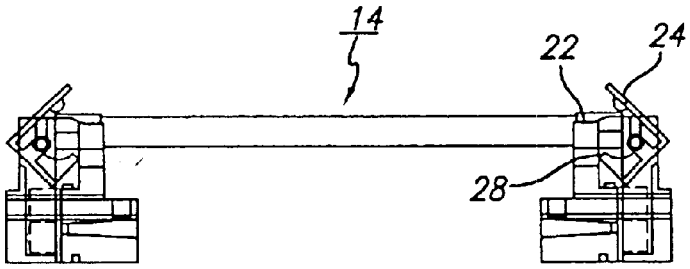
FIGS. 5A–5B, shows an intermediate stage of lamp insertion or removal.
Figure 5B:
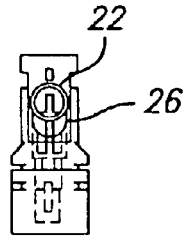

In FIGS. 5A and 5B, side and end views, respectively, depending upon the direction of motion, either the socket cover 24 is pushing the end caps 22 into engagement with the spring clips 26 or the supporting arm 28 is prying the end caps 22 from the spring clips 26.

Figure 6A:
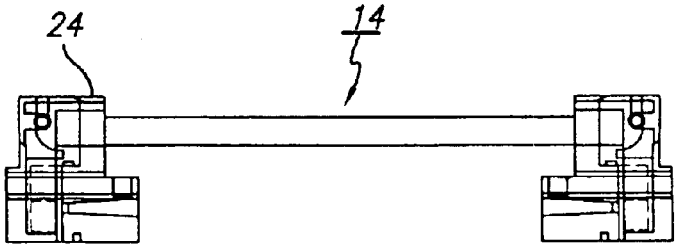
FIGS. 6A–6B, shows the final stage of lamp insertion or the initial stage of lamp removal.
Figure 6B:
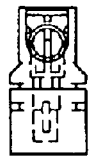

In FIGS. 6A and 6B, also side and end views, respectively, the CCFL 14 is shown fully seated in the spring clips 26 with the cover 24 holding the CCFL 14 in place and the supporting arm 28 clear of the CCFL 14. The supporting arms 28 can be in contact with the CCFL 14 so long as the contact does not adversely affect the electrical conduction between the spring clips 26 and the end caps 22.

Figure 7:
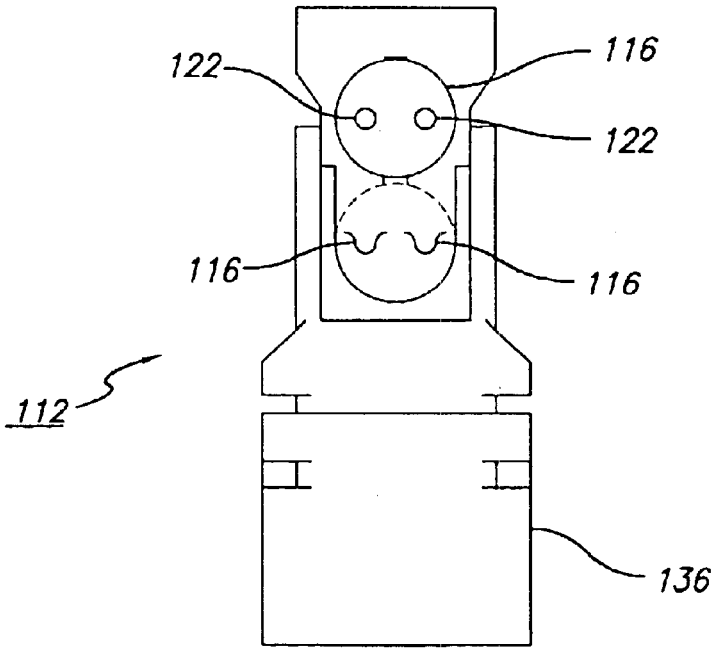
FIG. 7 is an end view of a socket according to the present invention designed for a conventional, dual pin fluorescent lamp.

In FIG. 7, a similar socket 112 is shown configured to work with the conventional fluorescent lamp 116 that utilizes a pair of conductive pins 122 (shown in phantom) to power the filaments that energize the lamp 116. The socket 112 has a rotating cover 124 and a pair of conductive spring clips 126 which receive the pins 122.

On the inner surface of the rotating cover 124 is an orienting protrusion 129 which aligns the pins 122 with the spring clips 126. The remainder of the structure is substantially similar to that of the preferred embodiment designed for CCFLs.

In operation, a fluorescent lamp 114 is placed on the open rotating covers 124 positioned at each end of the lamp 114. The orienting protrusion 129 need be found on only one of the sockets 112, but as a practical matter, will be placed on both. The lamp 114 then rests on the supporting arm 128, properly oriented to enter the spring clips 126 when the rotating covers 124 are closed.

Modifications and variations in the design will occur to those skilled in the art and the scope of the invention should be limited only by the claims appended below.

What is claimed is:

1. A socket assembly for a fluorescent lamp having at least one conductive element at each lamp end, the combination comprising:

a. socket base means for receiving a lamp;

b. conductive clip means adapted to be connected to a source of power and arranged to receive the lamp conductive element for supplying power to the lamp; and c. a rotating cover member, mounted in said socket base including an arm member for supporting the lamp when said cover member is rotated to an open position and for engaging the lamp and disengaging the lamp from said conductive clip means when said cover member is rotated from a closed position to the open position;

whereby a lamp can be positioned in the socket assembly with said cover member open and engaged with said conductive clip means by rotating said cover member from the open to the closed position and a lamp can be disengaged from said conductive clip means by rotating said cover member from the closed to open position.

2. The socket assembly of claim 1 wherein said conductive clip means include a substantially u-shaped contact member with an inward bend at the upper ends for retaining the lamp conductive element in place.

3. The socket assembly of claim 1 wherein the lamp has dual pin conductive elements at each end and wherein said conductive clip means include a pair of substantially u-shaped contact members, each having an inward bend at the upper ends for retaining the lamp conductive elements in place.

4. The socket assembly of claim 3 further including orienting means integral with the underside of said cover member for aligning the pins of a fluorescent lamp with said contact members.

5. The socket assembly of claim 1 wherein said cover member includes frictional retaining means cooperating with retaining means elements in said socket base means for engaging said cover member when in the closed position.

6. A socket assembly for fluorescent lamps comprising:

a. a socket base member having side walls and a front wall with an opening adapted to receive and accommodate a fluorescent lamp;

b. contact means in said base member adapted to engage a fluorescent lamp for supplying energy thereto;

c. a cover member, rotationally mounted in said base member and rotatable to open and closed positions; and d. a support arm, mounted to the underside of said cover member and positioned to hold the lamp with said cover member in the open position and to be clear of the lamp in the closed position;

whereby said cover member and said support arm act to insert a lamp into engagement with said contact means when said cover member is rotated from the open to the closed position and whereby said cover member and said support arm act to remove a lamp from engagement with said contact means when said cover member is rotated from the closed to the open position.

7. The socket assembly of claim 6 wherein said contact means are adapted to connect to a cold cathode fluorescent lamp.

8. The socket assembly of claim 6 wherein said contact means are adapted to connect to a dual pin fluorescent lamp.

9. The socket assembly of claim 8 further including orienting means integral with the underside of said cover member for aligning the pins of a fluorescent lamp with said contact members.

10. The socket assembly of claim 6 further including frictional holding means having elements on said cover member and said base member for resisting the opening of said cover member when said cover member is closed.

* * * * *